US012077964B2

(12) United States Patent
Sorkin

(10) Patent No.: US 12,077,964 B2
(45) Date of Patent: Sep. 3, 2024

(54) INTERMEDIATE ANCHOR ASSEMBLY

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 17/978,605

(22) Filed: Nov. 1, 2022

(65) Prior Publication Data

US 2023/0125237 A1 Apr. 27, 2023

Related U.S. Application Data

(62) Division of application No. 17/211,998, filed on Mar. 25, 2021, now Pat. No. 11,486,143.

(60) Provisional application No. 63/000,356, filed on Mar. 26, 2020.

(51) Int. Cl.

| | |
|---|---|
| ***E04C 5/12*** | (2006.01) |
| *E04C 5/08* | (2006.01) |
| *E04G 21/12* | (2006.01) |

(52) U.S. Cl.

CPC ..... *E04C 5/122* (2013.01); *E04C 5/08* (2013.01); *E04G 21/12* (2013.01)

(58) Field of Classification Search

CPC ..... E04C 5/08; E04C 5/122
USPC ..... 52/223.13
See application file for complete search history.

(56) References Cited

U.S. PATENT DOCUMENTS 2,372,200 A * 3/1945 Hayes ..... E04B 1/0023 52/432
2,590,685 A * 3/1952 Coff ..... B28B 23/046 52/294
2,699,589 A * 1/1955 Redell ..... F04B 27/047 294/102.1
3,226,894 A * 1/1966 Burchardt ..... E04B 1/22 261/DIG. 11
3,237,357 A * 3/1966 Hutchings ..... E04B 1/06 52/223.6
3,237,537 A * 3/1966 Hutchings ..... E01C 7/16 404/70

(Continued)

FOREIGN PATENT DOCUMENTS

DE 1047695 B * 12/1958 ..... E04C 5/122
EP 3128092 A1 * 2/2017 ..... A61K 31/337

(Continued)

*Primary Examiner* — Brian D Mattei
*Assistant Examiner* — Joseph J. Sadlon
(74) *Attorney, Agent, or Firm* — Hunton Andrews Kurth LLP

(57) ABSTRACT

An intermediate anchor assembly includes an encapsulated anchor having a front and rear encapsulation extensions. The assembly includes a cap with an outer surface and a front tube with an inside diameter that is greater than the outer diameter of a tension member. The assembly includes a front adapter that sealingly couples to the outer surface of the cap and sealingly couples to the outer surface of the front tube. The assembly includes a rear tube having an inside diameter that is greater than the outer diameter of the tension member. The assembly includes a rear adapter that sealingly couples to the rear encapsulation extension and sealingly couples to the outer surface of the rear tube. The assembly includes a first split seal sealingly fit between the tension member and the front tube and a second split seal sealingly fit between the tension member and the rear tube.

4 Claims, 4 Drawing Sheets

(56) References Cited

U.S. PATENT DOCUMENTS 3,341,995 A * 9/1967 Docken ..... E04C 3/18 52/223.13
3,516,211 A * 6/1970 Rieve ..... E04C 5/08 52/223.13
3,773,360 A * 11/1973 Timbers ..... F16L 37/088 285/321
4,621,943 A * 11/1986 Swanson ..... E01C 11/20 52/223.13
4,631,889 A * 12/1986 Adam ..... F16B 13/02 52/565
4,679,827 A * 7/1987 Law ..... H02G 3/0616 285/151.1
4,805,877 A * 2/1989 Hoekstra ..... G01L 5/06 15/257.06
5,423,362 A * 6/1995 Knight ..... B28B 23/043 249/97
5,491,948 A * 2/1996 Harris ..... E04C 2/06 52/250
6,185,884 B1 * 2/2001 Myers ..... E06B 1/6053 249/35
6,279,877 B1 * 8/2001 Davis ..... H02G 1/083 254/134.3 R
6,328,499 B1 * 12/2001 Reding ..... E04C 5/165 403/368
6,354,596 B1 * 3/2002 Rodriguez ..... E04C 5/12 52/223.13
7,549,261 B2 * 6/2009 Parish ..... E04G 21/185 52/170
7,967,532 B2 * 6/2011 Schmidt ..... E21D 21/0093 52/223.13
7,975,444 B2 * 7/2011 Holdsworth ..... E04B 1/043 52/565
8,087,204 B1 * 1/2012 Sorkin ..... E04C 5/122 52/223.13
8,286,309 B2 * 10/2012 Landry ..... E04C 5/122 52/223.13
8,534,974 B2 * 9/2013 Smith ..... F16B 37/0857 411/262
8,904,721 B2 * 12/2014 Pantelides ..... E01C 11/20 52/223.13
9,506,250 B2 * 11/2016 Gilling ..... F16B 9/056
10,118,314 B1 * 11/2018 Robbins ..... B28C 7/16
10,214,925 B2 * 2/2019 Hartman ..... E04G 21/185
2002/0083659 A1 * 7/2002 Sorkin ..... E04C 5/12 52/231
2007/0175127 A1 * 8/2007 Tanaka ..... E04G 23/0218 52/223.13
2007/0221894 A1 * 9/2007 Burtscher ..... E04C 5/122 24/115 M
2013/0174503 A1 * 7/2013 Olson ..... B28B 23/06 52/223.13
2016/0305140 A1 * 10/2016 Wilson ..... E04C 5/12 52/231

FOREIGN PATENT DOCUMENTS

FR 1113034 A * 3/1956 ..... F16G 11/108
FR 2623551 A1 * 5/1989 ..... E01D 19/16
GB 2538508 A * 11/2016 ..... E04C 5/122
WO WO-2008016543 A2 * 2/2008 ..... F16B 37/0857

* cited by examiner

INTERMEDIATE ANCHOR ASSEMBLY

CROSS-REFERENCE TO RELATED U.S. APPLICATIONS

This application is a nonprovisional application which claims priority from U.S. provisional application No. 63/000,356, filed Mar. 26, 2020, which is incorporated by reference herein in its entirety.

TECHNICAL FIELD/FIELD OF THE DISCLOSURE

The present disclosure relates generally to anchors for use in post-tensioning concrete, and specifically to intermediate anchors for post-tensioning tendons.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, bridges, pavement, tanks, reservoirs, silos, foundations, sports courts, and other structures.

The concrete may be poured into a concrete form. The concrete form may be a form or mold into which concrete is poured or otherwise introduced to give shape to the concrete as it sets or hardens thus forming a concrete member.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a post-tensioning tendon embedded in the concrete is tensioned after the concrete has attained a specified strength. The post-tensioning tendon may include for example and without limitation, anchorages, a tension member, sheathing, and ducts. The tension member may be constructed of a suitable material exhibiting tensile strength that can be elongated including, for example, reinforcing steel or composite material, in the form of single or multi-strand cable.

A post-tensioning tendon generally includes an anchorage at each end. The tension member is fixedly coupled to a fixed anchor positioned at one end of the post-tensioning tendon, sometimes referred to as the "fixed-end" or "dead end" anchor, and is stressed at the other anchor, sometimes referred to as the "stressing-end" or "live end" anchor.

The tension member is stressed by pulling the tension member through the stressing anchor; when the pulling force is released, the anchors grip the tension member and retain the tension member in tension. In some instances, the anchors grip the tension member using wedges, so that the gripping force increases when the tension on the tension member increases.

In some instances, it may be desirable to pour a long concrete slab in sections. In such instances, the sections are poured sequentially, with each pour section curing and being post-tensioned before the next, adjacent section is poured. In such instances, the anchors between adjacent slabs are known as "intermediate anchors." Because intermediate anchors typically entail an interruption of the sheathing that otherwise protects the tension member from corrosion, and because intermediate anchors are ultimately fully embedded in concrete, intermediate anchors need to be able to inhibit the ingress of liquid that may cause corrosion.

SUMMARY

The present disclosure provides for an intermediate anchor assembly. The intermediate anchor assembly includes an encapsulated anchor having a front encapsulation extension and a rear encapsulation extension. The intermediate anchor assembly also includes a cap, the cap having an outer surface and a front tube having a proximal end, a distal end, an outer surface, and an inside diameter that is greater than the outer diameter of a tension member. In addition, the intermediate anchor assembly includes a front adapter having a proximal end and a distal end, wherein the proximal end sealingly couples to the outer surface of the cap, and wherein the distal end sealingly couples to the outer surface of the proximal end of the front tube. The intermediate anchor assembly includes a rear tube having a proximal end, a distal end, an outer surface, and an inside diameter that is greater than the outer diameter of the tension member. In addition, the intermediate anchor assembly includes a rear adapter having a proximal end and a distal end, wherein the proximal end sealingly couples to the rear encapsulation extension, and wherein the distal end sealingly couples to the outer surface of the proximal end of the rear tube. Further, the intermediate anchor assembly includes a first split seal sealingly fit between the tension member and the distal end of the front tube and a second split seal sealingly fit between the tension member and the distal end of the rear tube.

The present disclosure also includes method for using an intermediate anchor assembly. The method includes providing a first concrete form assembly, the first concrete form assembly including a first concrete form, a first anchor affixed to the first concrete form, and a tension member extending through the first concrete form and the first anchor. The method also includes installing an intermediate anchor assembly on the tension member. The intermediate anchor assembly includes an encapsulated anchor having a front encapsulation extension and a rear encapsulation extension. In addition, the intermediate anchor assembly includes a cap, the cap having an outer surface and a front tube having a proximal end, a distal end, an outer surface, and an inside diameter that is greater than the outer diameter of the tension member. The intermediate anchor assembly also includes a front adapter having a proximal end and a distal end and a rear tube having a proximal end, a distal end, an outer surface, and an inside diameter that is greater than the outer diameter of the tension member. The intermediate anchor assembly also includes a rear adapter having a proximal end and a distal end. The method further includes affixing the encapsulated anchor to the first concrete form and coupling the rear tube to the rear adapter, coupling the rear adapter to the rear encapsulation extension, and inserting a split seal between the tension member and the distal end of the rear tube. In addition, the method includes placing concrete in the first concrete form so as to embed the first anchor and the encapsulated anchor in a first concrete pour and removing the first concrete form from first concrete pour. The method further includes inserting wedges into the encapsulated anchor, coupling the cap to the front encapsulation extension, coupling the front adapter to the cap, coupling the front tube to the front adapter, and inserting a second split seal between the tension member and the distal end of the front tube. The method includes providing a second concrete form assembly adjacent to the first concrete pour; the second concrete form assembly including a second concrete form and a third anchor affixed to the second concrete form, wherein the tension member extends through the third anchor and the second concrete form. Also, the method includes placing concrete in the second concrete form so as to embed the cap, front adapter, front tube, second split seal and third anchor in a second concrete pour.

DETAILED DESCRIPTION

Figure 1:
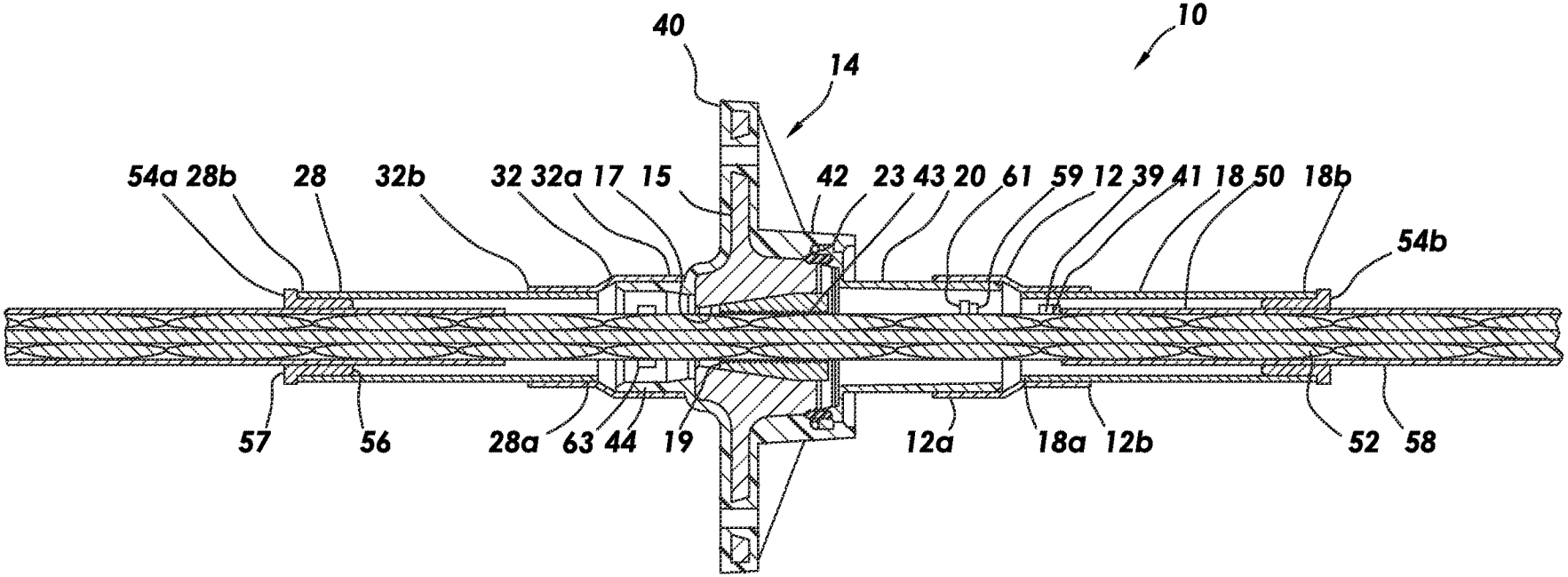
FIG. 1 is a cross section of an intermediate anchor assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals or letters in the various examples. This repetition is for the purpose of simplicity and clarity and does not in itself dictate a relationship between the various embodiments or configurations discussed.

Referring to FIG. 1, in some embodiments, intermediate anchor assembly 10 may include front tube 18, front adapter 12, cap 20, anchor 14, rear adapter 32, and rear tube 28. Tension member 50 may extend through intermediate anchor assembly 10. Tension member 50 may be cylindrical and include strand 52 and sheathing layer 58 surrounding strand 52.

Anchor 14 may include anchor body 15 at least partially surrounded by encapsulation 40 (referred to herein as an "encapsulated anchor"). Anchor body 15 may include bore 43 therethrough and frustoconical surface 17 adjacent the bore. One or more wedges 19 may be received within bore 43 and positioned adjacent frustoconical surface 17. The one or more wedges 19 may grip tension member 50 when a rearward (leftward, as drawn) force is applied to tension member 50. Encapsulation 40 may include a front encapsulation extension 42 and a rear encapsulation extension 44. Front encapsulation extension 42 may be annular. Front encapsulation extension 42 may or may not include a male or female engagement mechanism such as threads or bayonet tabs or a groove or ridge for securing a snap-fit with an adjacent component.

Cap 20 may mechanically couple to front encapsulation extension 42 and may include a female or male engagement mechanism, such as threads, bayonet tabs, one or more grooves, or one or more ridges that corresponds to and engages the engagement mechanism on front encapsulation extension 42. Cap seal 23 may be disposed between cap 20 and front encapsulation extension 42 such that cap seal 23 sealingly engages at least one of anchor body 15 or encapsulation 40 when cap 20 is coupled to front encapsulation extension 42. Cap seal 23 may be an O-ring or may be annular.

Figure 3:
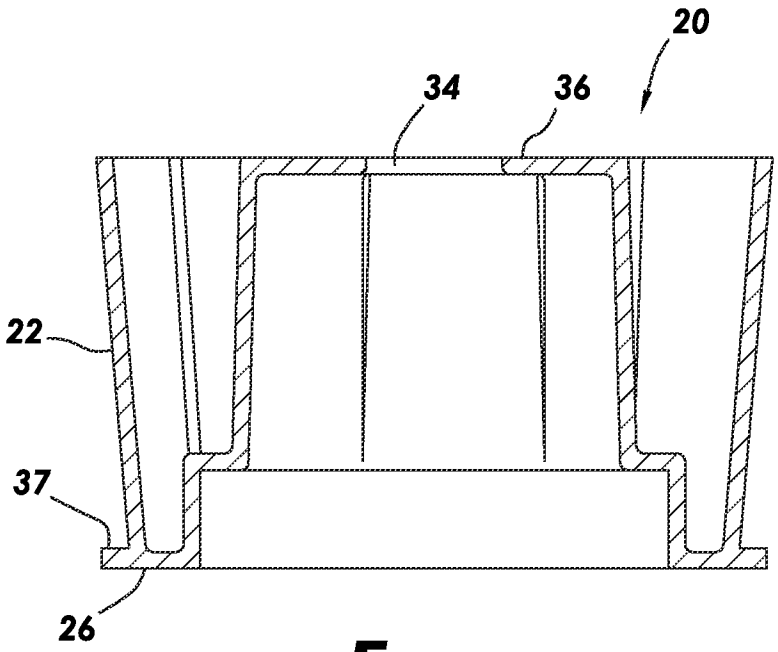
FIG. 3 is a cross section of an alternative embodiment of the cap of an intermediate anchor assembly shown in FIG. 2.
Figure 2:
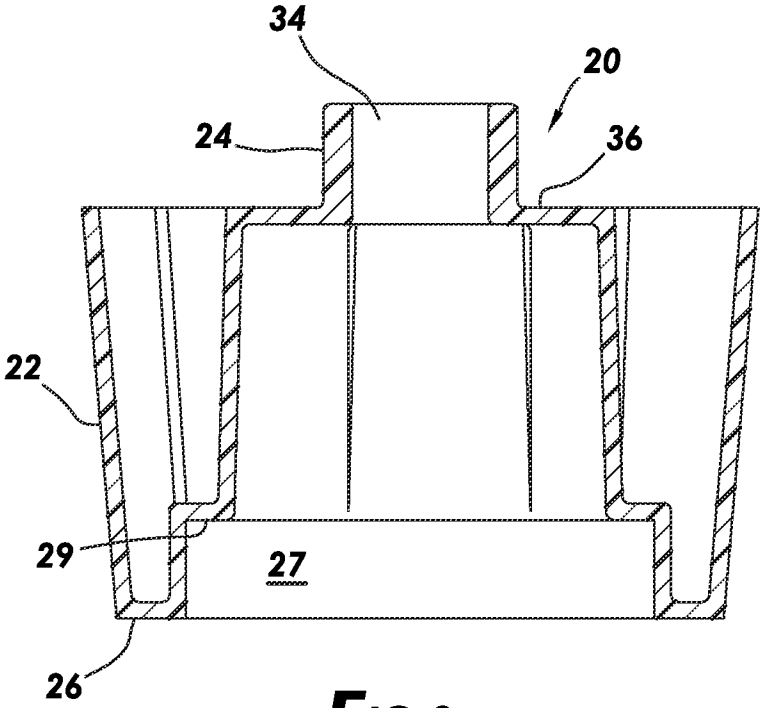
FIG. 2 is a cross section of a cap of an intermediate anchor assembly consistent with at least one embodiment of the present disclosure.

Referring to FIG. 2, cap 20 may include frustoconical pocket-forming wall 22, base 26, anchor-receiving portion 27, anchor seat 29, and end wall 36. A longitudinally extending gripping head 24 having a cable-opening 34 therethrough may extend from end wall 36. Gripping head 24 may be used to facilitate gripping, rotation, placement, or removal of cap 20. In some non-limiting embodiments, gripping head 24 may be hexagonal. In other embodiments and as illustrated in FIG. 3, cap 20 may not include a gripping head and may have instead end wall 36 with cable-opening 34 therethrough. As further shown in FIG. 3, base 26 may include encapsulation-engaging boss 37 that frictionally engages front encapsulation extension 42. In still other embodiments, one or more of the foregoing elements may not be present in cap 20, or cap 20 may comprise one or more elements in a different configuration from what is illustrated.

With further reference to FIG. 1, front and rear tubes 18, 28 may each be made of a polymer and may have an inside diameter that is greater than the outer diameter of tension member 50. Front and rear tubes 18, 28 may each have a proximal end 18*a*, 28*a*, respectively, and a distal end 18*b*, 28*b*, respectively. Front and rear tubes 18, 28 may each be positioned over tension member 50 by sliding anchor 14 from an end of tension member 50 to a desired location on tension member 50. Split seal 54*a* may be received on proximal ends 18*a* and 28*a* and split seal 54*b* on distal ends 18*b*, 28*b*.

Each of split seals 54*a*, 54*b* may be a split seal having a longitudinal slit that enables split seals 54*a*, 54*b* to be applied to a tension member from the side, i.e., the cylindrical face, without requiring access to an end of tension member 50. Split seals 54*a*, 54*b* may be made of an elastomer, elastomeric foam, rubber, silicone, or other deformable sealing material. Split seals 54*a*, 54*b* may be sized to fit in an annular space between proximal ends 18*a*, 28*a* and tension member 50 and distal tube ends 18*b*, 28*b* and tension member 50. In some embodiments, split seals 54*a*, 54*b* may each have seal body 56 and seal head 57. The inside diameter of each seal body 56 may be the same as, less than, or greater than the outer diameter of tension member 50 and the outer diameter of each seal body 56 may be the same as or greater than the inside diameter of tubes 18, 28. Split seals 54*a*, 54*b* may be in a compressed state when positioned in the annular space between front or rear tube 18, 28 and tension member 50. Split seals 54*a*, 54*b* can be applied to the side of tension member 50 and then slid along the tension member and into the annular space between front or rear tube 18, 28 and tension member 50.

In certain embodiments, front adapter 12 and rear adapter 32 may be sleeves. Front adapter 12 may include a proximal end 12*a* and a distal end 12*b*. Rear adapter 32 may include a proximal end 32*a* and a distal end 32*b*. Front adapter 12 and rear adapter 32 may each be made of an elastomer, rubber, silicone, or other suitably deformable sealing material. Proximal ends 12*a*, 32*a* of each adapter 12, 32 may have a larger inside diameter than the inside diameter of distal ends 12*b*, 32*b*. Thus, by way of example, proximal end 12*a* may be sized to sealingly couple to the outer surface of cap 20. Proximal end 32*a* may be sized to sealingly couple to the outer surface of rear encapsulation extension 44. Similarly and by way of example, distal end 12*b* may be sized to sealingly couple to the outer surface of front tube 18 and distal end 32*b* may sealingly couple to the outer surface of rear tube 28. In some embodiments, frictional engagement is achieved by ensuring that one or more of each adapter end, 12*a*, 12*b*, 32*a*, 32*b* has a smaller inside diameter than the outer diameter of the element with which it couples, so that the adapter is elastically deformed when it is frictionally coupled to that element.

In addition or alternatively, in some embodiments, each proximal adapter end 12*a*, 32*a* may include engagement feature 59, such as threads, one or more snap-in tabs, bayonet tabs, or grooves or ridges. In the embodiment illustrated in FIG. 1, engagement feature 59 on proximal adapter end 12*a* is a snap-in that engages slot 61 formed on cap 20 and the engagement feature on proximal adapter end 32*a* is a snap-in tab that engages a slot 63 formed in rear encapsulation extension 44. If present, each engagement feature 59 may retain the frictionally coupled elements in a desired relative position and reduce the likelihood of decoupling.

In some embodiments, each proximal tube end 18*a*, 28*a* may include an engagement feature, such as threads, snap-in tabs, bayonet tabs, or grooves or ridges. In the embodiment illustrated in FIG. 1, the engagement feature on proximal tube end 18*a* is a slot 41 that engages a snap-in tab 39 formed on front adapter 12 and the engagement feature on proximal tube end 28*a* is a slot that engages a snap-in tab formed on rear adapter 32. If present, each engagement feature may retain the frictionally coupled elements in a desired relative position and reduce the likelihood of decoupling.

As illustrated in FIG. 1, tension member 50 may extend through the interior of intermediate anchor system 10. When the components of intermediate anchor assembly 10 are assembled, intermediate anchor assembly 10 may provide a liquid-tight seal from distal tube end 18*b* to distal tube end 28*b*.

Operation

Figure 4:
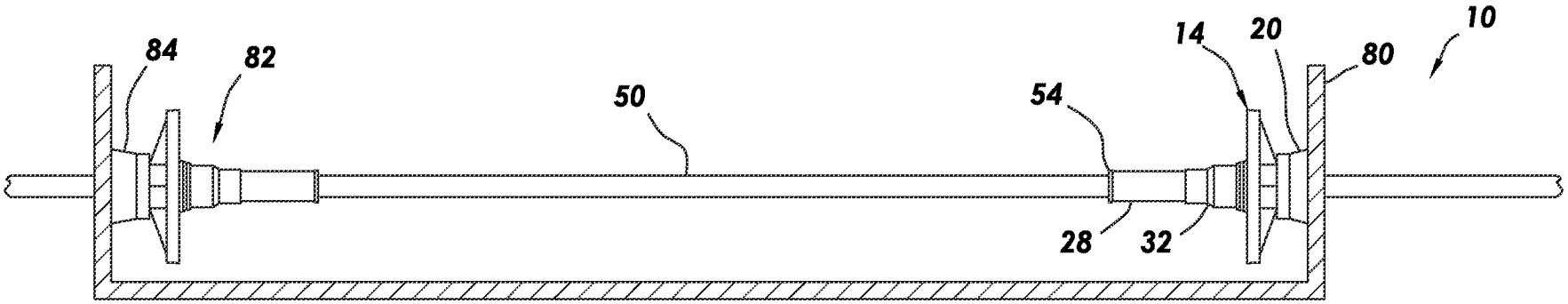
FIGS. 4-6 are cross-sections illustrating steps in a method for using an intermediate anchor assembly consistent with at least one embodiment of the present disclosure.

Referring now to FIG. 4, to install an intermediate anchor in the course of creating a concrete construction member, concrete form 80 having tension member 50 extending therethrough may be provided. A first anchor 82 may be positioned at one end of tension member 50. First anchor 82 may be attached to concrete form 80 by any suitable fasteners and may include any suitable fixed-end anchor or stressing-end anchor. If a pocket is desired, pocket former 84 may be installed between anchor 14 and concrete form 80.

At the other end of tension member 50, an intermediate anchor assembly 10 in accordance with the embodiments described above may be used. As described above, cap 20 may include a pocket forming element; if not and if a pocket is desired, a separate pocket former 84 may be installed between anchor 14 and concrete form 80, as at first anchor 82.

In some embodiments, selected components of intermediate anchor assembly 10 may be applied to tension member 50 as tension member 50 is installed in concrete form 80. Specifically, in some embodiments, rear tube 28, rear adapter 32, anchor 14, and cap 20 may be threaded onto an end of the tension member 50 and slid along tension member 50 to the desired location. Anchor 14 may be affixed to concrete form 80 by any suitable means, including by way of example, fasteners that may be placed through holes in anchor encapsulation 40. A first split seal 54*b* may also be applied and slid along tension member and into the space between rear tube 28 and tension member 50.

Some or all of the components of intermediate anchor assembly 10 may be pre-assembled prior to delivery to the pour site or may be assembled at the pour site. For example, components of intermediate anchor assembly 10 that are adapted to be mechanically coupled, such as rear tube 28, rear adapter 32, and anchor 14, may be provided in either a coupled or decoupled state. Split seals 54 may be but are not necessarily included in or with the pre-assembly. If included, split seals 54 may be removed before initiation of some installation steps.

Still further, because intermediate anchor assembly 10 is adapted for use at the interface between a first concrete pour and a second, adjacent concrete pour, portions of intermediate anchor assembly 10 may be installed before a first concrete pour in concrete form 80 and portions of intermediate anchor assembly 10 may be installed between the first pour and a second pour. Tension member 50 may extend through both concrete pours.

Figure 5:
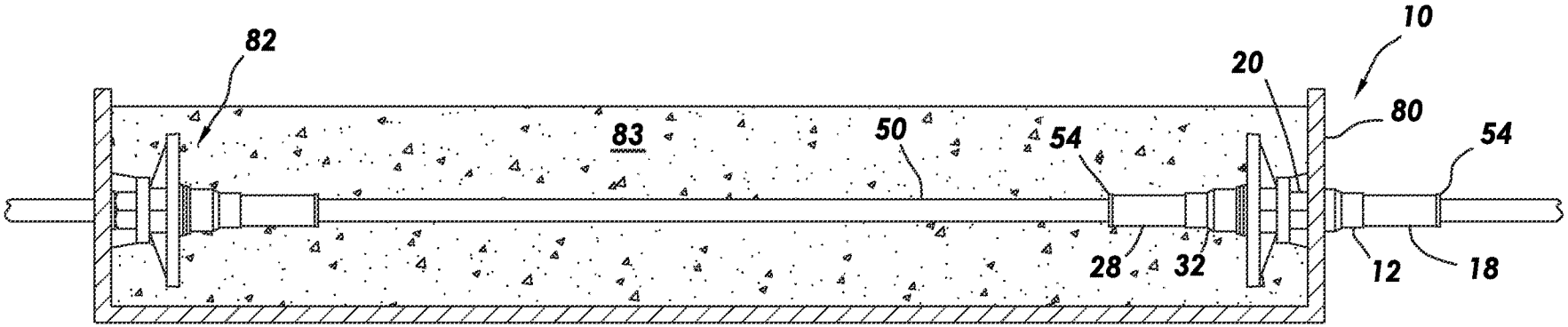
Figure 6:
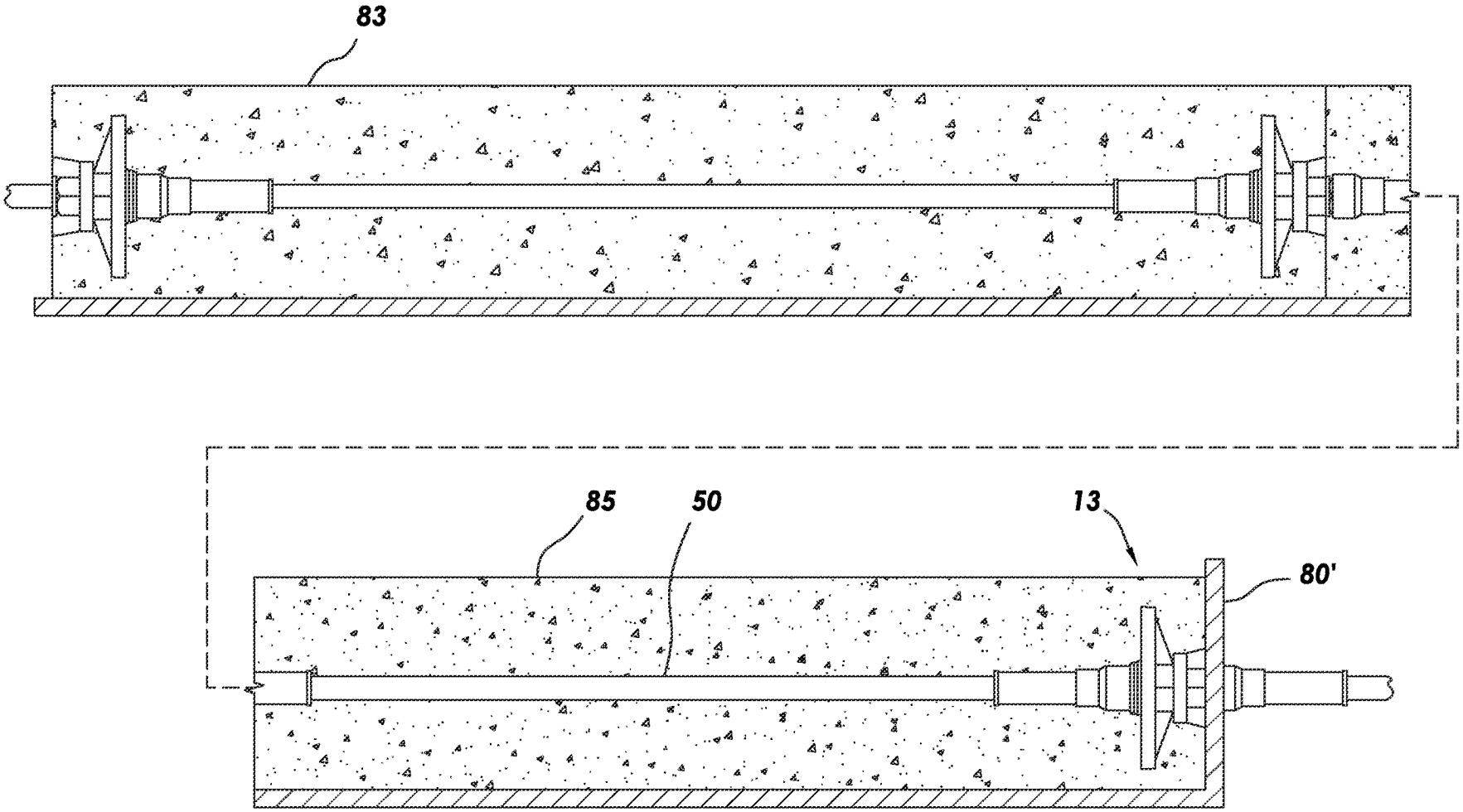

By way of example and referring to FIGS. 5 and 6, once anchors 82, 14 have been installed in concrete form 80, a first concrete pour 83 may be poured into concrete form 80. Once first concrete pour 83 has cured to a desired degree, concrete form 80 may be removed and a second concrete form 80' can be assembled so as to abut first concrete pour 83. Second concrete form 80' may include a third anchor 13 positioned on tension member 50. If desired, cap 20 may be decoupled from anchor 14 and slid along tension member 50 so as to allow access to the anchor bore. If present, the pocket former may be removed. Wedges 19 may be seated in anchor 14 prior to tensioning tension member 50. Once wedges 19 are seated and tension member 50 has been tensioned, cap 20 may be recoupled to the anchor 14. With cap 20 recoupled to the anchor, front adapter 12 and front tube 18 may be slid along tension member 50 and into engagement with cap 20. Alternatively, cap 20, front adapter 12, and front tube 18 may be coupled together as a preassembly prior to engagement with anchor 14. A second split seal 54*a* may be slid into the space between front tube 18 and tension member 50.

With second split seal 54*a* in place, intermediate anchor assembly 10 may be considered fully assembled. In some embodiments, in the fully assembled state, intermediate anchor assembly 10 may include no internal voids. In some embodiments, in the fully assembled state, intermediate anchor assembly 10 may provide a fluid-tight seal along the entire portion of tension member 50 that is enclosed therein, i.e. between first and second split seals 54*b*, 54*a*.

With intermediate anchor assembly 10 fully assembled, the portion of tension member 50 in first concrete pour 83 may be tensioned. With second concrete form 80' and third anchor 13 in place, a second concrete pour 85 may be poured. Intermediate anchor assembly 10 thus allows intermediate tensioning and provides corrosion protection for tension member 50 at the interface between first and second concrete pours 83, 85. Tensioning of the portion of tension member 50 embedded in first concrete pour 83 may occur before or after pouring or tensioning of second concrete pour 85. If second concrete pour 85 has not occurred, tensioning of the portion of tension member 50 in first concrete pour 83 may be accomplished at either end of first concrete pour 83. If second concrete pour 85 occurs before the portion of tension member 50 in first concrete pour 83 has been tensioned, the portion of tension member 50 in first concrete pour 83 may be tensioned at first anchor 82.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Unless expressly so indicated, the sequential recitation of steps in the claims that follow is not intended to indicate or require that the claims must be performed in the recited sequence.

What is claimed:

1. A method for using an intermediate anchor assembly, comprising:

a) providing a first concrete form assembly, the first concrete form assembly including a first concrete form, a first anchor affixed to the first concrete form, and a tension member extending through the first concrete form and the first anchor;

b) installing an intermediate anchor assembly on the tension member, the intermediate anchor assembly comprising:

an encapsulated anchor having a front encapsulation extension and a rear encapsulation extension;

a cap, the cap having an outer surface;

a front tube having a proximal end, a distal end, an outer surface, and an inside diameter that is greater than the outer diameter of the tension member;

a front adapter having a proximal end and a distal end, a rear tube having a proximal end, a distal end, an outer surface, and an inside diameter that is greater than the outer diameter of the tension member;

a rear adapter having a proximal end and a distal end;

c) affixing the encapsulated anchor to the first concrete form;

d) coupling the rear tube to the rear adapter, coupling the rear adapter to the rear encapsulation extension, and inserting a split seal between the tension member and the distal end of the rear tube;

e) placing concrete in the first concrete form so as to embed the first anchor and the encapsulated anchor in a first concrete pour;

f) removing the first concrete form from the first concrete pour;

g) inserting wedges into the encapsulated anchor, coupling the cap to the front encapsulation extension, coupling the front adapter to the cap, coupling the front tube to the front adapter, and inserting a second split seal between the tension member and the distal end of the front tube;

h) providing a second concrete form assembly adjacent to the first concrete pour; the second concrete form assembly including a second concrete form and a third anchor affixed to the second concrete form, wherein the tension member extends through the third anchor and the second concrete form;

i) placing concrete in the second concrete form so as to embed the cap, front adapter, front tube, second split seal and third anchor in a second concrete pour; characterized in that the first anchor is a stressing-end anchor, further including stressing the tension member in the first concrete pour after step i).

2. The method of claim 1, further including stressing the tension member in the first concrete pour before step i).

3. The method of claim 1, further including stressing the tension member in the first concrete pour before step g).

4. The method of claim 1, wherein the first anchor is a stressing-end anchor, further including stressing the tension member in the second concrete pour before stressing the tension member in the first concrete pour.

* * * * *